US005134776A

United States Patent [19]

Moody

[11] Patent Number: 5,134,776

[45] Date of Patent: Aug. 4, 1992

[54] HYDRAULICALLY ACTUATED HAND-HELD WIRE CUTTER

[75] Inventor: Jack M. Moody, Milwaukie, Oreg.

[73] Assignee: Cranston Machinery Co., Inc., Milwaukie, Oreg.

[21] Appl. No.: 745,255

[22] Filed: Aug. 14, 1991

[51] Int. Cl.[5] ..... B26B 17/00

[52] U.S. Cl. ..... 30/187; 30/180

[58] Field of Search ..... 30/187, 180, 228, 210, 30/216; 83/600, 601, 530

[56] References Cited

U.S. PATENT DOCUMENTS

| | | | |
|---|---|---|---|
| 1,440,264 | 12/1922 | Arn | 30/187 |
| 2,716,812 | 9/1955 | Noonan | 30/187 |
| 3,177,583 | 4/1965 | Fischer et al. | 30/180 |
| 3,310,872 | 3/1967 | Dowdell | 30/187 |
| 3,372,479 | 3/1968 | Fischer | 30/180 |
| 3,670,411 | 6/1972 | Peters | 30/187 |
| 3,733,699 | 5/1973 | Bock | 30/180 |
| 3,834,215 | 9/1974 | Lemley | 30/180 |
| 3,837,076 | 9/1974 | Good, Jr. | 30/180 |
| 3,893,237 | 7/1975 | Jahnke | 30/180 |
| 4,031,619 | 6/1977 | Gregory | 30/180 |
| 4,057,897 | 11/1977 | Seymour | 30/180 |
| 4,285,126 | 8/1981 | Orwin | 30/180 |
| 4,526,076 | 7/1985 | Hogan | 83/600 |
| 4,707,918 | 11/1987 | Smith et al. | 30/228 |
| 4,949,461 | 8/1990 | van der Merwe et al. | 30/180 |

FOREIGN PATENT DOCUMENTS

| | | | |
|---|---|---|---|
| 1017299 | 12/1952 | France | 30/228 |
| 722160 | 1/1955 | United Kingdom | 30/180 |

OTHER PUBLICATIONS

"Electrical World", p. 70, Mar. 1964.

*Primary Examiner*—Douglas D. Watts
*Assistant Examiner*—Hwei-Siu Payer
*Attorney, Agent, or Firm*—Lee R. Schermerhorn

[57] ABSTRACT

A hand-held tool has cutter blades actuated by a power wedge on a piston rod in an hydraulic cylinder. The hydraulic cylinder is powered by a compressed air supply through stationary apparatus containing an air-hydraulic pressure intensifier apart from the tool and connected therewith through a hydraulic line. The power wedge has inclined ramps at relatively steep angles of inclination to start closing of the blades quickly, and ramps at less steep angles to increase the force applied to the blades in cutting. An adjusting wedge stops the advance of the power wedge so that the blades do not strike each other. The tool may have an elongated rear extension with a pistol grip handle.

9 Claims, 3 Drawing Sheets

HYDRAULICALLY ACTUATED HAND-HELD WIRE CUTTER

BACKGROUND OF THE INVENTION

As stated in the title this invention relates to a hydraulically actuated hand-held wire cutter. Such cutters require a stop to limit the closing movements of the blades and prevent the cutting edges from striking and damaging each other. Such a stop must be adjustable to allow for re-sharpening of the cutting edges from time to time, which increases the range of the closing movements.

Previous adjustments for this purpose have been too complicated and expensive to manufacture. A more simple form of adjustment is needed.

Heretofore such cutters have generally been pneumatically actuated which limits the cutting force in a hand-held tool of convenient size operated by an air pressure in commonly available air supply lines.

SUMMARY OF THE INVENTION

The present tool is actuated by hydraulic pressure of sufficient magnitude to make the tool compact and of a small size for convenient manipulation. The desired hydraulic pressure is produced by stationary apparatus separate from the tool, which apparatus is supplied by air pressure from a commonly available air supply line.

The closing movements of the blades are stopped by a sliding wedge which limits the movement of an hydraulic piston in the tool. This makes the stop conveniently adjustable over a wide range to allow for repeated re-sharpening of the cutting edges of the blades.

An air-hydraulic pressure intensifier is included to provide the necessary pressure for a small tool.

A pistol grip handle with a trigger switch may be mounted directly on the body of the cutter or on an extension tube of any desired length.

The invention will be better understood and the foregoing features and advantages will become apparent from the following description of the preferred embodiments illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figures 1, 2, 2A, 3A, 3B, 3C:
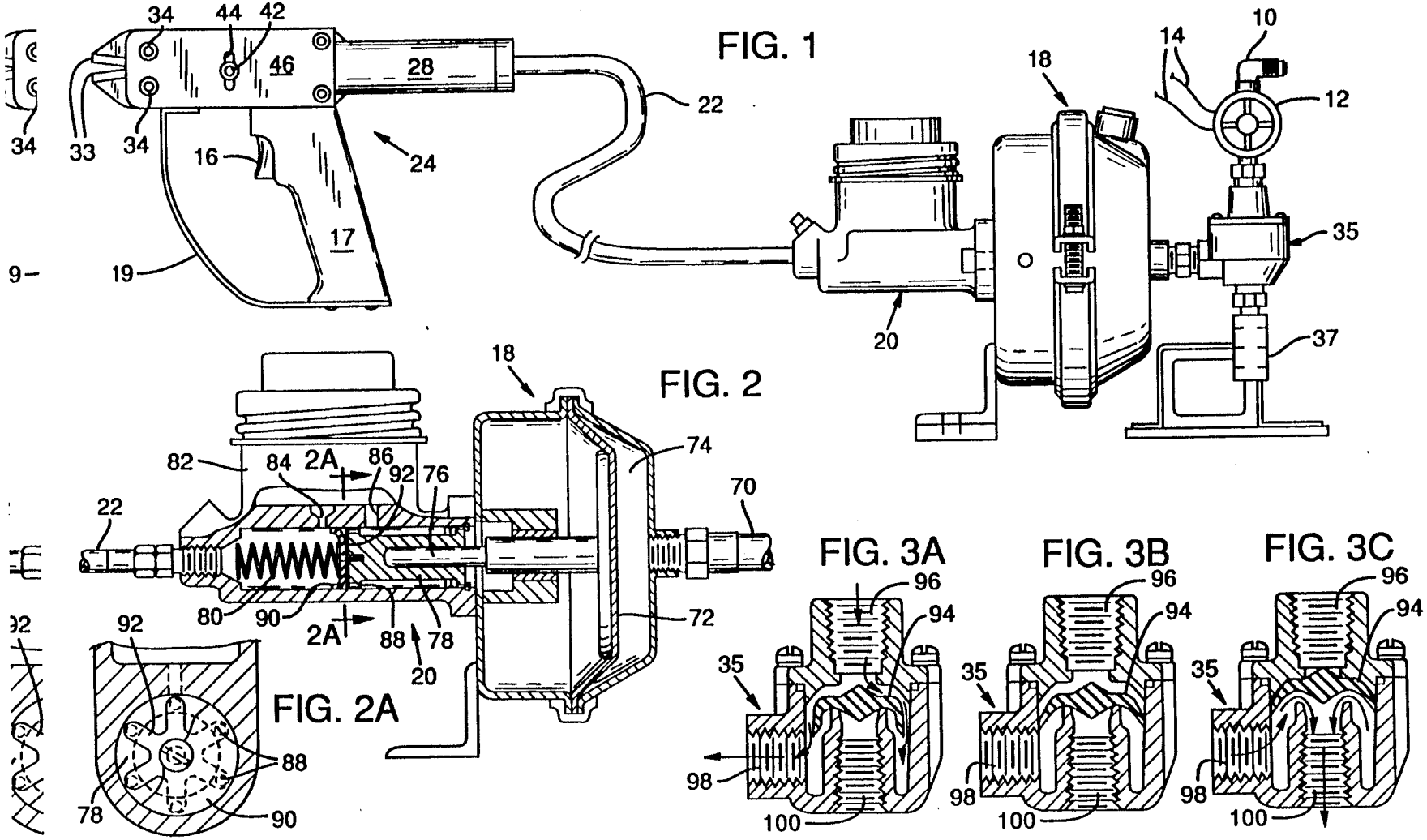
FIG. 1 is a side elevation view of the cutter including the stationary apparatus for producing the necessary hydraulic pressure from a conventional air pressure supply line.
FIG. 2 is a vertical longitudinal sectional view of the air-hydraulic pressure intensifier in FIG. 1.
FIG. 2A is an enlarged cross section view on the line 2A—2A in FIG. 2.
FIGS. 3A, 3B and 3C are vertical sectional views of the quick dump valve in FIG. 1, showing three different operating positions of the valve.

In FIG. 1 air at a regulated pressure is fed into air inlet fitting 10 which is attached to a solenoid valve 12. The valve is opened by a circuit through wires 14, which circuit is closed by trigger switch 15 in FIG. 4 actuated by trigger 16 on the pistol grip handle 17. Handle 17 is mounted on the body of the cutter and includes hand and trigger guard 19.

The air, controlled by solenoid valve 12 is applied to the pressure side of the air diaphragm in air-hydraulic pressure intensifier 18. This moves the diaphragm toward the hydraulic master cylinder 20 whereby a rod fastened to the diaphragm pushes the piston in the master cylinder 20 forward, producing an hydraulic pressure pulse in the hose 22 supplying the powered wire cutter 24.

Figure 4:
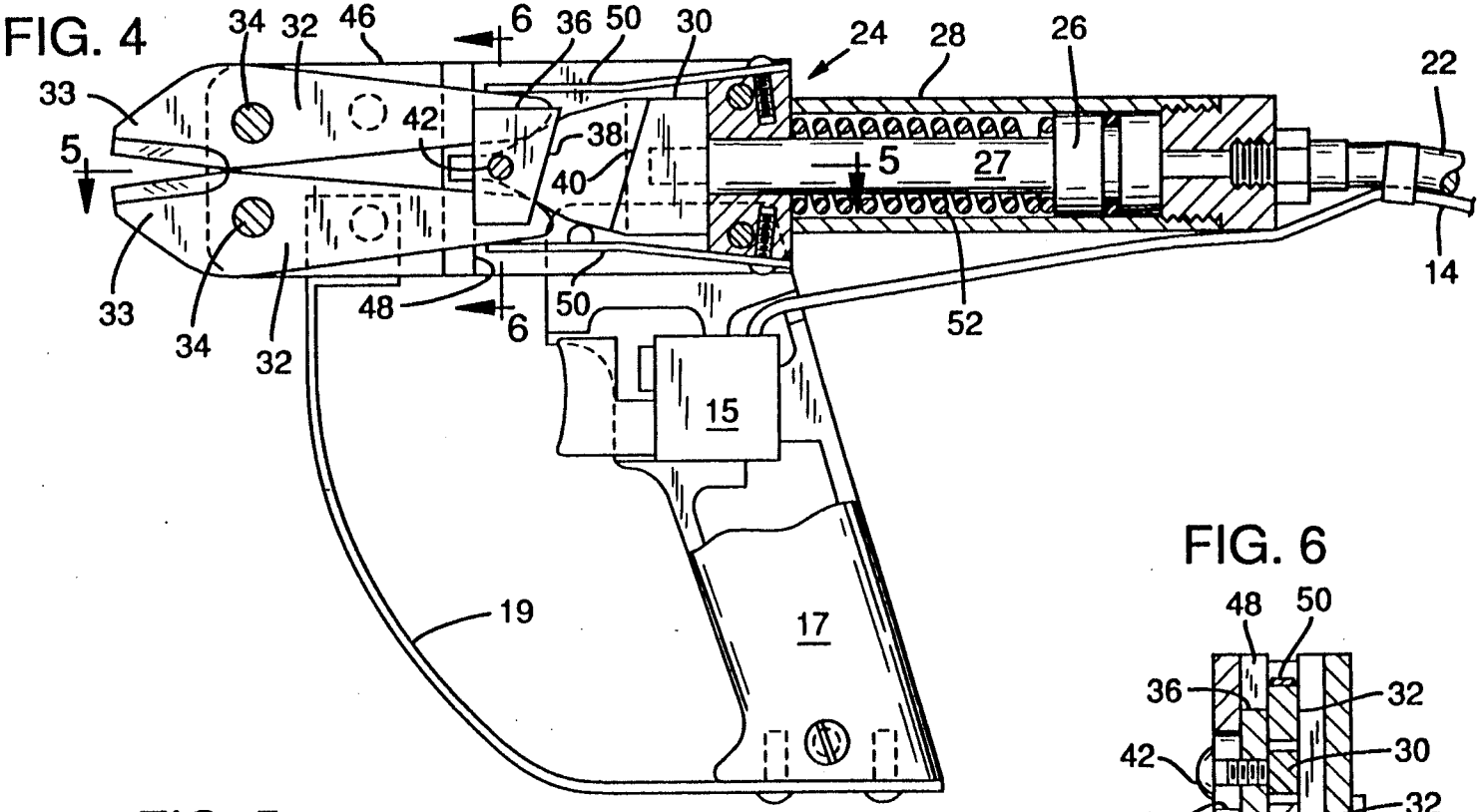
FIG. 4 is an enlarged view in vertical longitudinal section of the cutter in FIG. 1 showing details of its operating mechanism.

When this pressure pulse is applied to the rear of the cutter piston 26 in FIG. 4 the piston is forced forward. The hydraulic master cylinder 20 is capable of delivering more liquid during any single cycle than cutter cylinder 28 is capable of using during a cut cycle. This is to assure a constant force on the cutter piston until the trigger switch has been released.

Attached to the rod end 27 of cutter piston 26 is power wedge 30. The power wedge is forced between the rounded ends of cutter arms 32. This action forces the cutter arms to pivot on the cutter pivot pins 34. Wire or other materials placed between the blade ends 33 of the cutter arms will be cut as the blade ends are forced tightly together.

When trigger switch 15, 16 is released, solenoid valve 12 closes and pneumatic quick dump valve 35 opens to relieve the pneumatic pressure in the air chamber of pressure intensifier 18 and hydraulic pressure in cylinder barrel 28 for quick opening of the cutter blades. The air is exhausted through a conventional exhaust silencer 37.

In FIG. 4 adjusting wedge 36 has an angled surface 38 parallel to angle surface 40 on the power wedge 30. Adjusting wedge 36 is adjustable transversely to provide a positive stop for the power wedge 30. It may be adjusted to prevent the cutter blades 33 from striking together during the cutting operation and prevent the hard and sharp cutting edges from chipping each other.

Another reason for the adjusting wedge is to allow re-sharpening of the cutting edges on the cutter blades 33 when they do chip or wear during normal operation. The adjusting wedge 36 may be raised up toward the top of the cutter in FIG. 4 to allow the cutter blades to come closer together after re-sharpening, and still prevent them from striking each other during normal operation.

Figure 6:
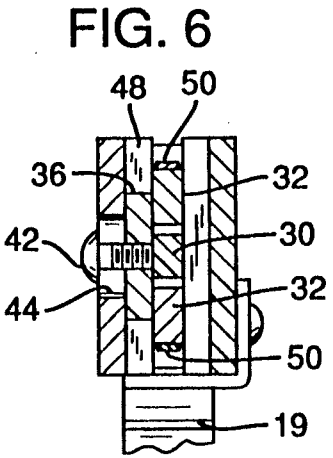
FIG. 6 is a cross sectional view on the line 6—6 in FIG. 4.
Figure 5:
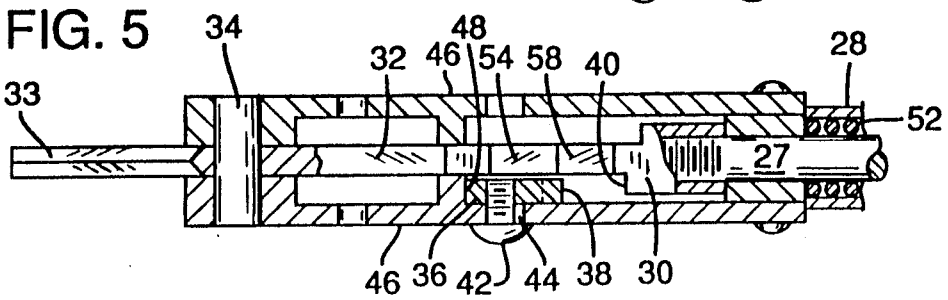
FIG. 5 is a longitudinal sectional view on the line 5—5 in FIG. 4.
Figure 7B:
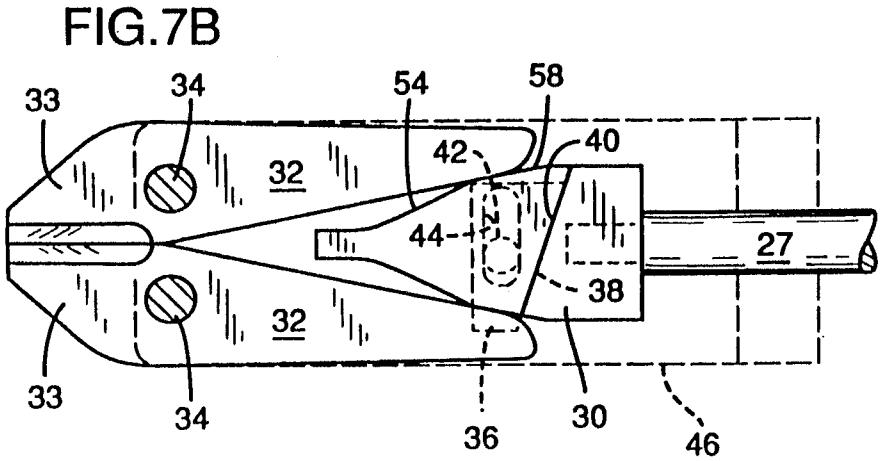
FIG. 7B is a similar view showing the blades in closed position.

Further details of the adjustable wedge mechanism are shown in FIGS. 4, 5 and 6. Adjusting wedge 36 is shifted up and down in FIG. 4 by a buttonhead screw 42 which is loosened to slide in a slot 44 in one of the cutter side plates 46 as best seen in FIG. 5. The forward surface of wedge 36 is slidable in adjustment on the vertical surface 48 in FIG. 4. Thus the wedge 36 is adjusted to limit the forward stroke of power wedge 30 when the cutting edges of blades 33 reach closed position as shown in FIG. 7B.

Figure 7A:
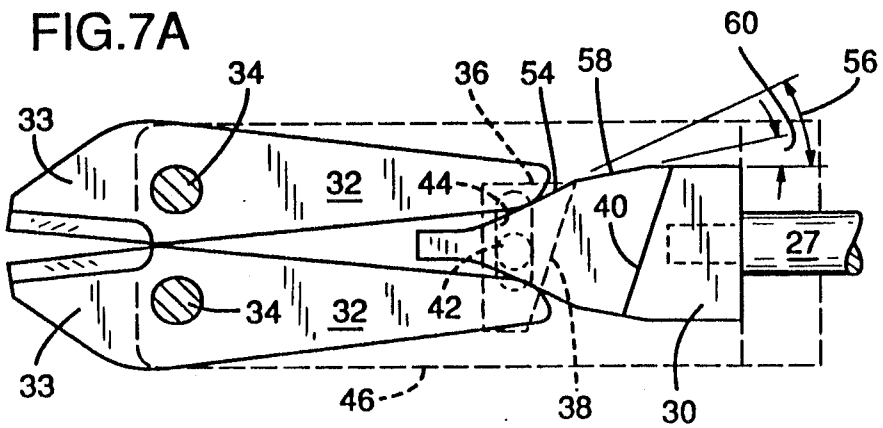
FIG. 7A is a view of the blades and power wedge in FIG. 4 with the blades in open position.

Leaf springs 50 bear on arms 32 to open the cutter blades 33 when power wedge 30 is retracted by piston return spring 52. Power wedge 30 has steeply angled surfaces 54 on its forward end at an angle 56 of 28 degrees to start closing the cutter blades quickly when the power wedge starts to move forward as seen in FIG. 7A. As the blades approach closing position they are moved by a more powerful force by less steeply angled surfaces 58 at angles 60 of 16 degrees.

Figure 8:
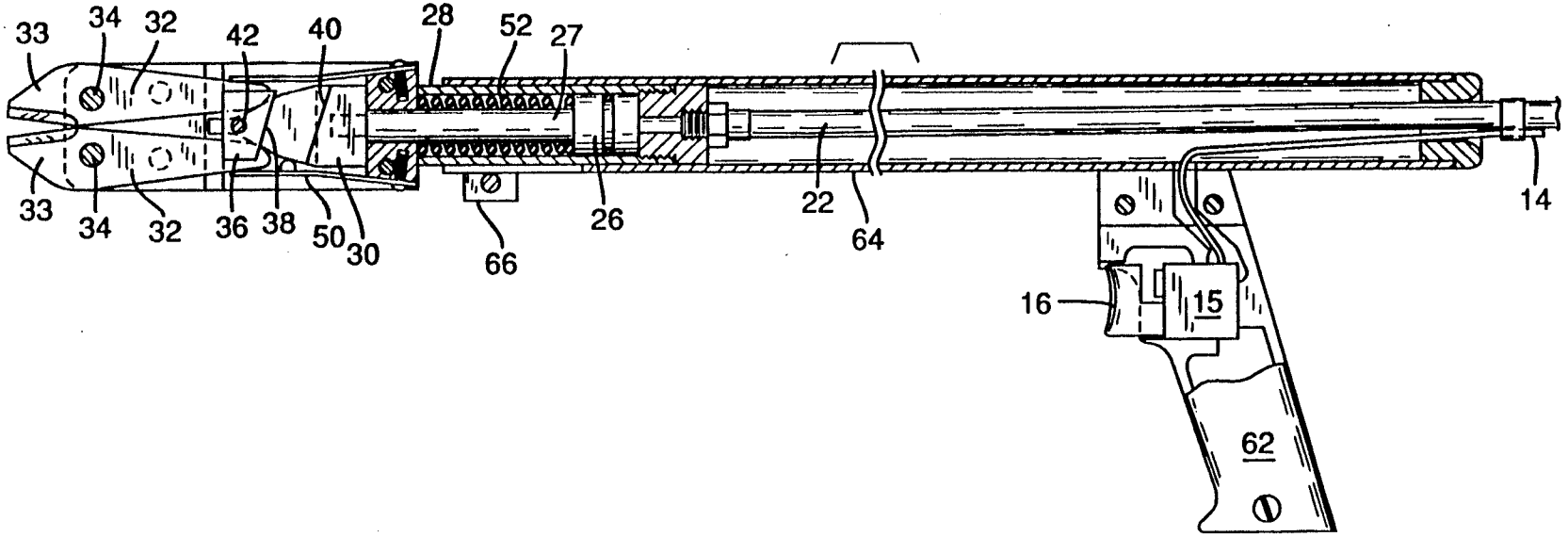
FIG. 8 is a view similar to FIG. 4 showing a modification having an extension for mounting the handle at a distance from the blades.

In FIG. 8 pistol grip handle 62 is mounted on tube handle extension 64 which at its forward end is mounted on cylinder barrel 28 by clamp 66.

FIG. 2 illustrates details of the air-hydraulic pressure intensifier 18 which includes hydraulic master cylinder 20. When solenoid valve 12 in FIG. 1 is opened by trigger switch 15, 16 air pressure is introduced through inlet 70 to actuate diaphragm 72 in diaphragm chamber 74. This moves plunger 76 and piston 78 to the left in the master cylinder producing an operating pressure in hydraulic hose 22. When solenoid valve 12 is closed at the completion of the cutting strokes of the cutter blades 33 return spring 80 shifts piston 78 and diaphragm 72 back to the right as these parts appear in FIG. 2.

Cylinder 20 is provided with an hydraulic reservoir 82 having liquid replenishing passages 84 and 86 into cylinder 20 on opposite sides of the head of piston 78 in retracted position. The head of piston 78 has small holes 88 to admit the passage of the makeup liquid. Under the seal 90 on the head of the piston a thin metal check valve has fingers 92 overlying the holes 88. When the piston retracts, this check valve opens to draw makeup liquid into the piston chamber if required. During the power stroke the small holes 88 are closed by the check valve fingers 92 to force the liquid out the discharge port of the master cylinder into hydraulic line 22.

The operation of conventional quick dump valve 35 is illustrated in FIGS. 3A, 3B, and 3C. The valve body contains a resilient free floating rubber valve part 94 operating between an inlet 96, an outlet 98 and an exhaust 100. FIG. 3A shows an open path between the inlet port 96 and the outlet port 98 to allow pressurized air to pass into the diaphragm chamber 74 in FIG. 2. The exhaust port 100 is blocked by the rubber flapper valve which will remain in this position only as long as air is flowing into diaphragm chamber 74.

FIG. 3B shows the valve 94 in a relaxed position while the pressure at the inlet port 96 and the outlet port 98 are equal. This condition exists when no air is flowing through the air circuit between solenoid valve 12 and diaphragm chamber 74.

FIG. 3C shows the rubber flapper valve blocking the inlet port 96 while providing a clear path between the outlet port 98 and exhaust port 100 for the air exhausting from diaphragm chamber 74 under the force of spring 80 and hydraulic pressure in line 22 acting on piston 78.

Thus when solenoid valve 35 is opened by trigger switch 15, 16 the cutter blades 33 are closed by an hydraulic pressure far exceeding the air pressure available in conventional air supply lines and, when the solenoid valve is closed, the air pressure contained in the system is instantly exhausted through a quick relief valve closely adjacent the diaphragm chamber 74.

What is claimed is:

1. A cutting tool comprising a pair of cutting blades with confronting sharpened edges projecting forward from pivot pins supporting the blades for opening and closing movements, lever arms on said blades extending rearward from said pivot pins for opening and closing the blades, spring means bearing against and pressing said lever arms together to open said blades, a power wedge movable between said lever arms to force said lever arms apart and close said blades, and an adjusting wedge to limit the power stroke of said power wedge, said adjusting wedge being slidable on a surface of the tool perpendicular to the direction of movement of the power wedge, and having a rear side inclined parallel to an inclined stop surface on the power wedge.

2. A cutting tool as defined in claim 1 including a stationary side plate having a slot parallel to a forward side of said adjusting wedge, and a button head screw in said adjusting wedge slidable in said slot and clamping the adjusting wedge in adjusted position.

3. A cutting tool as defined in claim 1, said power wedge having first inclined ramp surfaces adjacent the leading end of the power wedge to start the closing of the cutting blades as the power wedge starts to move forward, and second ramp surfaces behind said first ramp surfaces at lesser angles of inclination to the direction of wedge movement than said first ramp surfaces.

4. A cutting tool as defined in claim 3, the angle of inclination of said first ramp surfaces being approximately 28 degrees and the angle of inclination of said second ramp surfaces being approximately 16 degrees.

5. A cutting tool as defined in claim 1 including a hydraulic cylinder having a piston connected to said power wedge, a hydraulic master cylinder supplying hydraulic pressure to said power wedge cylinder, a piston in said master cylinder connected to one side of a diaphragm in a diaphragm chamber on the opposite side of said diaphragm, an air pressure supply controlled by a solenoid valve connected to said diaphragm chamber, and a trigger switch on said tool controlling said solenoid valve.

6. A cutting tool as defined in claim 1 including a piston in an hydraulic cylinder connected to said power wedge, a air-hydraulic pressure intensifier having a hydraulic cylinder connected with said hydraulic cylinder in the tool, a piston in said cylinder in said pressure intensifier actuated by a diaphragm in the pressure intensifier, and a compressed air supply connected to a diaphragm chamber containing said diaphragm for deflecting the diaphragm.

7. A cutting tool as defined in claim 1 including an extension on the rear end of the tool and a pistol grip handle on said extension.

8. A portable hand carried cutting tool comprising cutting blades actuated by a wedge on a piston rod on a piston in a hydraulic cylinder in the tool, an air-hydraulic pressure intensifier in combination with the tool having a hydraulic cylinder, a flexible tube interconnecting said two cylinders said pressure intensifier having a piston in its cylinder connected to a diaphragm in a diaphragm chamber, an air pressure supply connected to said diaphragm chamber, a hydraulic reservoir on said hydraulic cylinder in said pressure intensifier, liquid replenishing passages between said reservoir and said last cylinder in front of and behind a head of the piston therein, in a retracted position of the piston, openings in said piston head, and a check valve on said piston head at forward ends of said openings.

9. A tool as defined in claim 8 including a solenoid valve controlling said air pressure supply, and a switch on said tool connected to and controlling said valve.

* * * * *